US005153605A

United States Patent [19]

Ohara et al.

[11] Patent Number: 5,153,605

[45] Date of Patent: Oct. 6, 1992

[54] SYSTEM OF CONTROLLING ENERGIZATION TO THERMAL HEAD IN THERMAL PRINTER

[75] Inventors: Terumi Ohara, Iwai; Kenichi Miyazaki; Shinichi Hoshino, both of Ibaraki; Tomohiko Matsumoto, Iwai, all of Japan

[73] Assignee: Victor Company of Japan, Ltd., Yokohama, Japan

[21] Appl. No.: 635,005

[22] Filed: Dec. 27, 1990

[30] Foreign Application Priority Data

Dec. 27, 1989 [JP] Japan ..... 1-341336
Feb. 27, 1990 [JP] Japan ..... 2-19339[U]

[51] Int. Cl.[5] ..... B41J 2/36

[52] U.S. Cl. ..... 346/76 PH; 358/298; 400/120

[58] Field of Search ..... 346/76; 358/298; 400/120

[56] References Cited

U.S. PATENT DOCUMENTS

| | | | |
|---|---|---|---|
| 4,621,271 | 11/1986 | Brownstein | 346/76 PH |
| 4,724,336 | 2/1988 | Ichikawa et al. | 346/76 PH |
| 4,751,520 | 6/1988 | Mizoguchi | 346/76 PH |
| 4,827,279 | 5/1989 | Lubinsky et al. | 346/76 PH |
| 4,833,124 | 5/1989 | Lum | 503/227 |
| 4,835,569 | 5/1989 | Samejima et al. | 346/76 PH |
| 4,845,520 | 7/1989 | Mori | 346/76 PH |
| 4,849,775 | 7/1989 | Izumi | 346/151 |

FOREIGN PATENT DOCUMENTS

| | | | |
|---|---|---|---|
| 0078769 | 5/1985 | Japan . | |
| 1287769 | 12/1986 | Japan | 346/76 PH |
| 63-151469 | 6/1988 | Japan | 346/76 PH |
| 0241262 | 2/1990 | Japan | 346/76 PH |

*Primary Examiner*—Joseph W. Hartary
*Assistant Examiner*—Huan Tran
*Attorney, Agent, or Firm*—Lowe, Price, LeBlanc & Becker

[57] ABSTRACT

An energization control system for controlling energization of a thermal head of a thermal printer, the thermal head being equipped with a plurality of heating elements successively arranged in line, which are energized to generate heat in response to supply of currents thereinto so as to thermally and gradationally print an image on a recording sheet with printing densities corresponding to the supplied currents. The system comprises a density correction data memory for storing density correction data corresponding to variations of resistances of the heating elements and a calculation circuit for correcting an image signal on the basis of the density correction data so as to produce image data. Also included is a data comparison circuit selectively coupled through a switching device to the density correction data memory and the calculation circuit for comparing first and second comparison signals with the density correction data and the image data. The data comparison circuit performs first energization so as to energize the heating elements in accordance with the comparison result between the first comparison signal and the density correction data and, after completion of the first energization, performs second energization so as to energize them in accordance with the comparison result between the second comparison signal and the image data.

3 Claims, 8 Drawing Sheets

6
$R_n$
$R_2$
$R_1$
$T_n$
$T_2$
$T_1$
$V_T$
$G_n$
$G_2$
$G_1$
VCC
28
17
16
LATCH CIRCUIT
SHIFT REGISTER
21
15
LEVEL COUNTER
14
COMPARING CIRCUIT
L1
11
ADDRESS COUNTER
24
SW1
22
PULSE GENERATOR
J
(J1, J2)
K1
CLOCK
12
CALCULATION CIRCUIT
25
CORRECTION DATA MEMORY
23
8
INPUT DEVICE
9
A/D CONVERTER
10
DATA MEMORY

6
Rn
R2
R1
Tn
T2
T1
VT
Gn
G2
G1
VCC
28
17
16
LATCH CIRCUIT
SHIFT REGISTER
21
15
LEVEL COUNTER
14
COMPARING CIRCUIT
L1
11
ADDRESS COUNTER
26
SW2
24
SW1
22
PULSE GENERATOR
J
(J1, J2)
K1
CLOCK
12
27
K2
CALCULATION CIRCUIT
25
CORRECTION DATA MEMORY
23
8
INPUT DEVICE
9
A/D CONVERTER
10
DATA MEMORY

SYSTEM OF CONTROLLING ENERGIZATION TO THERMAL HEAD IN THERMAL PRINTER

BACKGROUND OF THE INVENTION

The present invention relates generally to thermal printing apparatus, and more particularly to a system of controlling energization or actuation of a thermal head in a thermal printer for gradational or multi-level density printing of images.

As printing apparatus for printing images (including characters and figures) formed by computer graphics or others is known a thermal transfer type printing apparatus (printer) in which an ink film 1 comprising a polyester-made film 2 having on its surface heat-fusible ink or heat-sublimation ink, together with the recording sheet 4, is interposed between a line thermal head 6 and a platen roller 5 so as to be movable in accordance with rotation of the platen roller 5. The line thermal head comprises a plurality of heating elements (resistors) to generate heat in response to currents successively supplied from an external device whereby ink is transferred from the ink film onto a surface of the recording sheet for printing. The density determining the gradation of an image printed depends on the area of each dot due to the heating element of the line thermal head in the case of using the heat-fusible ink, while depending upon the sublimation amount for each dot in the case of using heat-sublimation ink. Generally, the heat value of the heating element increases as the time that the current passes through the heating element (which will be referred hereinafter to as energization time) becomes longer so that the area of the dot printed with the heat-fusible ink becomes greater and the ink sublimation amount of the dot printed with the heat-sublimation ink becomes larger so as to cause the density of the printed image to become higher.

FIG. 1 is a graphic diagram showing a transfer characteristic of the heat-fusible ink or heat-sublimation ink, where X1 represents a threshold at which point the ink starts fusing or sublimating. As obvious from FIG. 1, the ink transfer characteristic has a S-figure like configuration and thus the printing preferably requires the control to linearize the ink transfer characteristic. For instance, in the interval up to the threshold point X1 (the interval between 0 and X1), each heating element of the line thermal head is pre-heated by means of a batch energization that a constant current is applied to each heating element for a constant time so as to control the rising of the ink density characteristic. Moreover, in the interval from the threshold point X1 to a predetermined point X2 (which allows the printing), the energization time for each heating element is controlled in correspondance with the resistance of each heating element for gradation control in the color printing. However, there is a problem which arises with such a conventional gradation control, in that the heat values of the respective heating elements are different from each other and further the heat-transferring amounts to the recording sheet by the respective heating elements are different from each other. This is due to the fact that the resistances of the respective heating elements are different from each other and the pressing forces of the line thermal head to the ink film and the recording sheet varies at every place. Thus, there is the possibility that in the pre-heating some of the heating elements do not reach the threshold point X1 and some of the other heating elements exceed the threshold point X1, whereby the density difference (density irregularity) can occur in the printed image and further the recording sheet can be stained in the printing. This stain occurs due to the fact that the ink is undesirably transferred or sublimated up to non-printed portions on the recording sheet due to overheating of the heating element in the pre-heating.

Moreover, for improving the quality of the printed image, there is recently a need to more heighten the maximum density of a printed image particularly in multi-color printing. One possible solution is to increase the power to be applied to the thermal head after the concurrent heating or pre-heating. There is a problem, however, in that the applied power is in non-linear relationship to the image-printing density and hence correction is required for providing the linear relationship therebetween whereby limitation is imposed upon increase in the maximum image-printing density under the condition that the number of density levels is kept constant. Another possible solution is to lengthen the time period of the concurrent heating or pre-heating. However, difficulty is encountered to realize a lower density image with a high quality because the basic density inevitably becomes higher. In addition, there is the possibility that the recording sheet is stained when printing.

SUMMARY OF THE INVENTION

It is therefore an object of the present invention to provide an energization control system for a thermal head of a thermal printer which is capable of surely keeping the quality of a printed image irrespective of variations of the thermal head in resistance and others and further which is capable of heightening the maximum density without deteriorating the quality of a lower-density portion of the printed image.

With this object and other features which will become apparent as the description proceeds, according to the present invention, there is provided an energization control system for controlling energization of a thermal head of a thermal printer, the thermal head being equipped with a plurality of heating elements successively arranged in line, which are energized to generate heat in response to supply of currents thereinto so as to thermally and gradationally print an image on a recording sheet with printing densities corresponding to the supplied currents. The energization control system, being responsive to an image signal whereby the thermal printer prints the image on the recording sheet through the thermal head, comprises density correction data memory means for storing density correction data corresponding to variations of resistances of the heating elements, and calculation circuit means coupled to the density correction data memory means for correcting the inputted image signal on the basis of the density correction data so as to produce image data. Also included in the energization control system are level counter means arranged to act as an up-counter and a down-counter for generating first and second comparison signals, and data comparison means coupled to the level counter means and further selectively coupled through switching means to the density correction data memory means and the calculation circuit means for comparing the first and second comparison signals with the density correction data from the density correction data memory means and the image data from the calculation circuit means. The data comparison means performs first energization so as to energize the heating elements of the thermal head in accordance with the comparison result between the first comparison signal and the density correction data and, after completion of the first energization, performs second energization so as to energize the heating elements thereof in accordance with the comparison result between the second comparison signal and the image data.

Preferably, the switching means is arranged so as to effect a switching operation so that the data comparison means is coupled to the calculation means for performing the second energization after elapse of a predetermined time period from the completion of the first energization.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
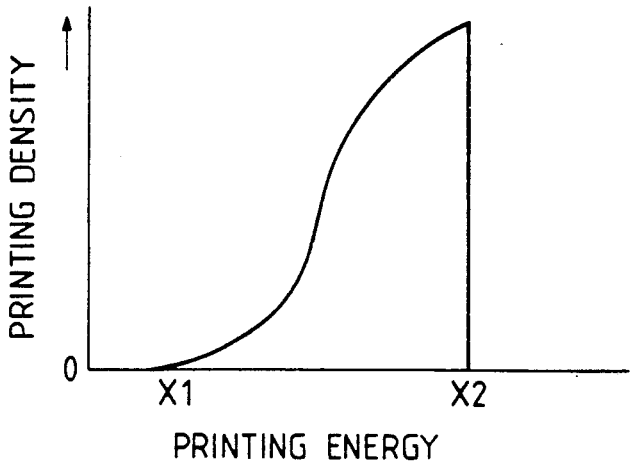
FIG. 1 PRIOR ART
FIG. 1 is a graphic illustration of the relation between the printing density and the energization energy for describing a problem inherent to conventional thermal printers.
Figure 2:
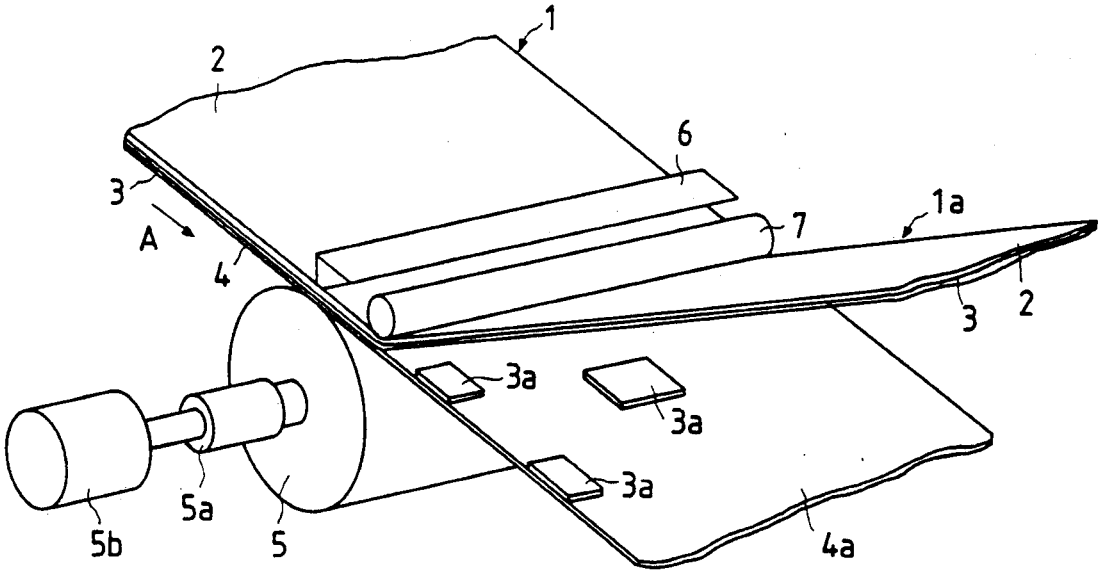
FIG. 2 is a perspective view of a portion of a thermal printer into which an energization control system according to the present invention is incorporated.
Figure 3:
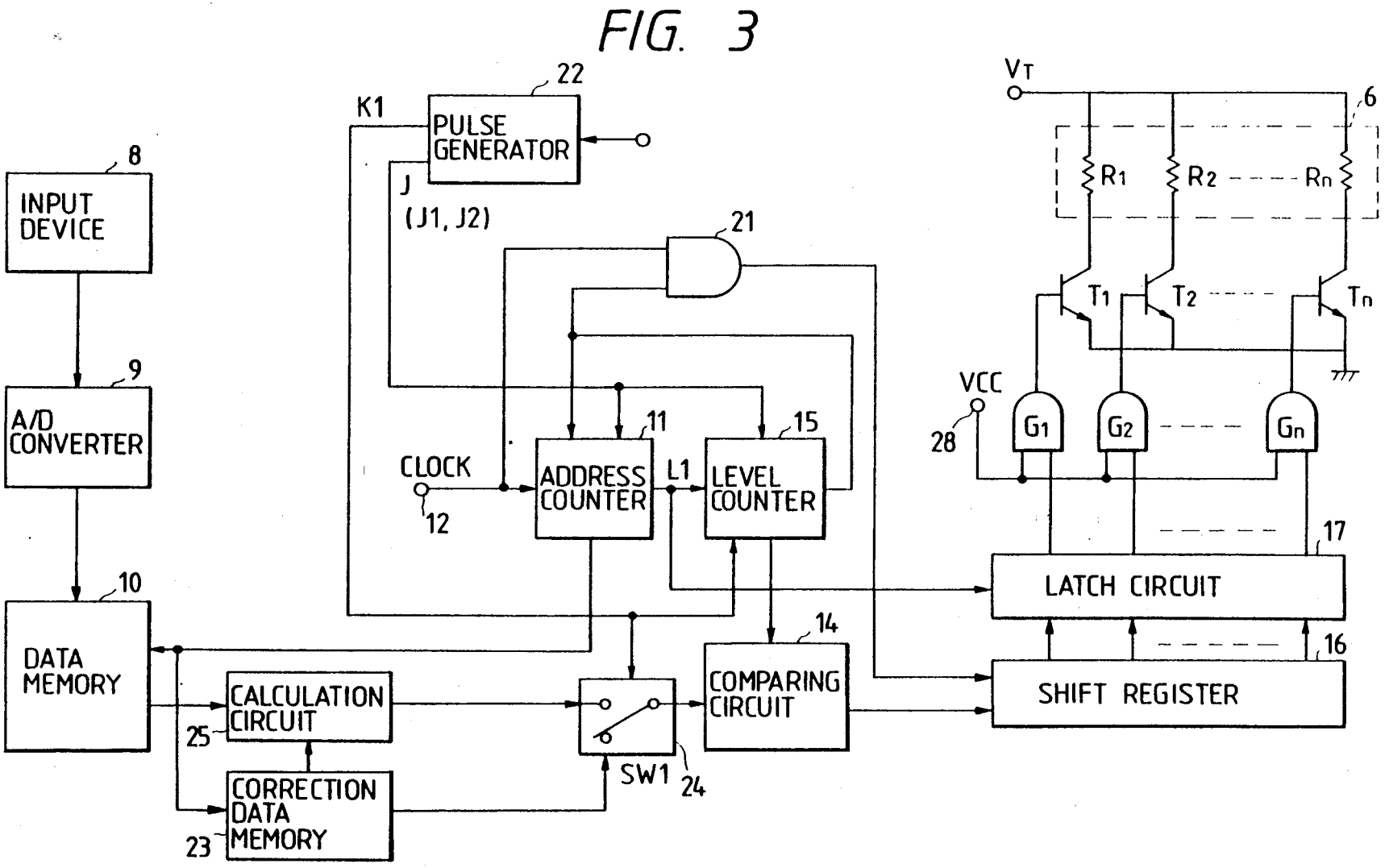
FIG. 3 is a block diagram showing an energization control system according to a first embodiment of this invention.

Referring now to FIG. 2, there is illustrated an arrangement of a thermal transfer type color pinter, and in FIG. 3, there is illustrated an energization control system according to a first embodiment of the present invention for controlling energization to each heating element of a line thermal head of the thermal-transfer type color printer as illustrated in FIG. 2. One feature of this first embodiment is that the pre-heating (first energization) for a line thermal head equipped with a plurality of heating elements arranged successively in line is made by supplying currents to the plurality of heating elements (energizations of the heating elements) in accordance with density data corrected in correspondance to the variations in the resistances of the heating elements. Another feature of this embodiment is that heating (second energization) is effected by supplying currents to the heating elements in accordance with image data corrected in correspondance with the variations in the resistances of the respective heating elements. The first and second energizations are respectively effected at every printing corresponding to one line of an image to be printed, thereby printing the image with repetitions of the first and second energizations.

In FIGS. 2 and 3, illustrated at numeral 6 is a line thermal head equipped with a plurality of heating elements (heating resistors) R1 to Rn placed on a ceramic-made base (not shown) so as to be successively arranged in line in directions perpendicular to the longitudinal directions of an ink film 1 (corresponding to a direction A of the movement of the ink film 1 due to a platen roller 5 which is rotatable in response to a power from a drive device, not shown). The ink film 1 has thereon heat-fusible ink or heat sublimation ink 3 to be transferred to a recording sheet 4 in correspondance with energizations of the heating elements R1 to Rn. After being released from the thermal head 6 and guided by a roller 7, the ink film 1 is separated from the recording sheet 4 so as to be wound around a take-up roller (not shown) as a used ink film 1*a*. Numeral 3*a* designates portions ink-transfered on a printed recording sheet 4*a* due to the energizations of the heating elements R1 to Rn, each of the ink-transferred portions 3*a* being a group of dots printed. Each of the dots, being formed by each of the heating elements R1 to Rn, has a size depending on the magnitude or application time of a current passing through each of the heating elements R1 to Rn. Further, the density (i.e., gradation) of the printed image depends upon the dot size when using the heat-fusible ink 3 in the ink film 1 or the sublimation amount when using the heat-sublimation ink 3 therein.

Illustrated at numeral 5*b* is an encoder which is coupled through a coupling member 5*a* to one end portion of a rotation shaft of the platen roller 5 so as to be rotatable with the platen roller 5. The encoder 5*a* is arranged to generate one reference pulse every one revolution of the platen roller 5 and further produces 1500 control pulses (for example) every one revolution of the platen roller 5. The control system according to this embodiment performs control in accordance with the number of the control pulses on the basis of the reference pulse, which will be described hereinafter in detail. Here, the repetition period of the control pulses corresponds to the printing time for one line of the line thermal head 6.

In FIG. 3, illustrated at numeral 8 is an image signal inputting device for receiving an image signal supplied from an external circuit, not shown. An analog image signal from the image signal inputting device 8 is led to an analog-to-digital (A/D) converter 9 to be converted into a digital image signal, which is in turn stored in a data memory 10. Here, although in this embodiment the image signal inputting device 8, the A/D converter 9 and the data memory are used as an input means, this embodiment is not limited to this arrangement but it is also appropriate that only the input means is constructed to receive a digital image signal from an external circuit. Further, although in this embodiment the image signal is stored in the data memory 10, in the case that a digitized sequential image signal synchronized is used as the digital image signal, the memory 10 can be omitted. However, this arrangement may be required to satisfy certain conditions such as address control processing speed.

Figure 4:
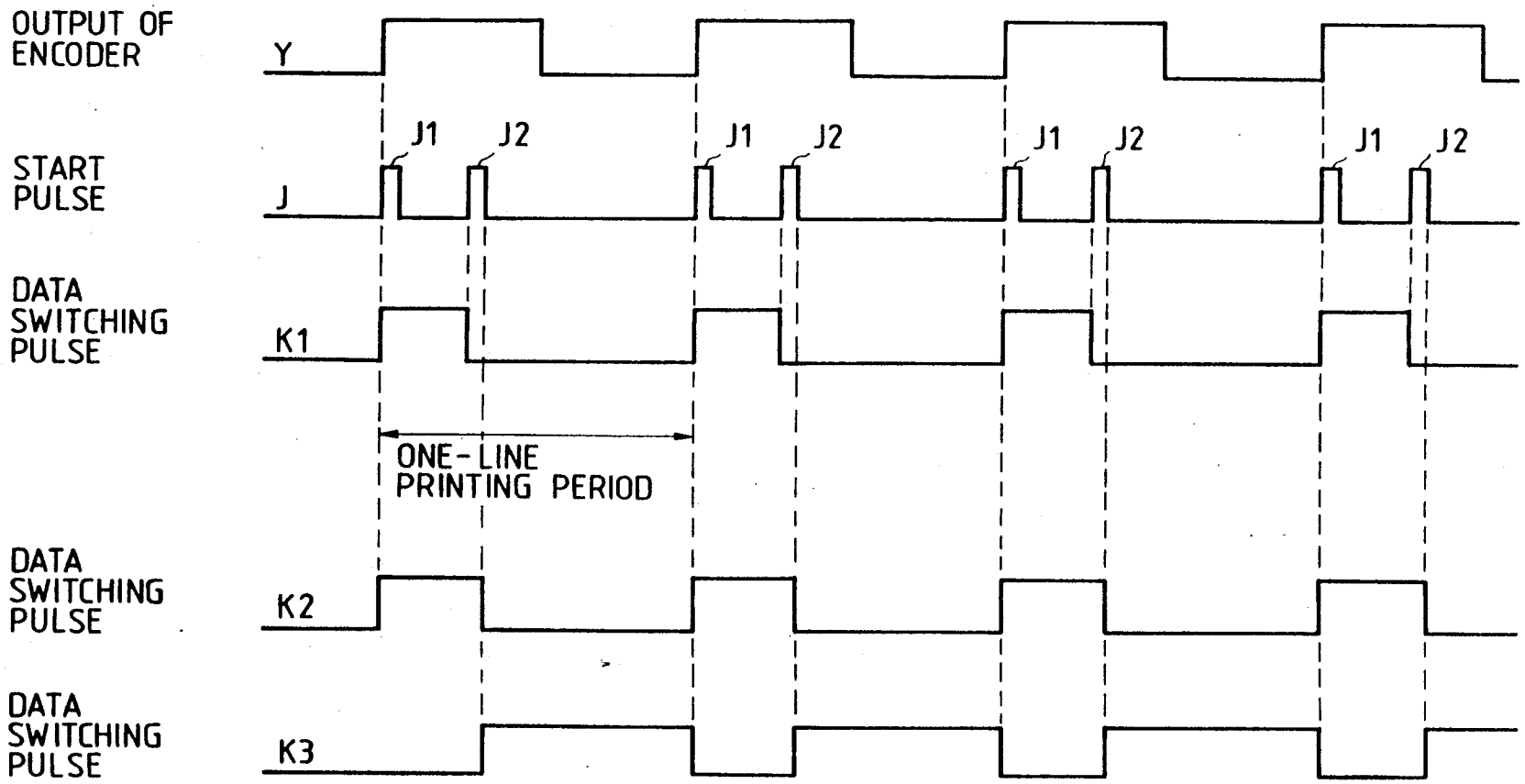
FIG. 4 is a timing chart for describing operation of an energization control system according to this invention.

The control pulses (Y pulses) outputted from the encoder 5*b* illustrated in FIG. 2 are inputted in a pulse generator 22 which in turn, generates a start pulse signal J and a data-switching pulse signal K1 on the basis of the inputted control pulses Y. As illustrated in FIG. 4, the start pulse signal J comprises a pulse J1 synchronized with the rising (leading edge) of each of the control pulses Y and a pulse J2 produced after elapsed by a predetermined time from the generation of the pulse J1. Each pulse of the data-switching pulse signal K1 is produced in connection with the pulses J1 and J2 of the start pulse signal J. That is, each pulse K1 is a pulse which rises in synchronism with the leading edge of the start pulse J1 and falls in synchronism with the leading edge of the other start pulse J2 and whose repetition period is coincident with that of the start pulse J1 and further coincident with that of the control pulse Y.

Returning back to FIG. 3, the data-switching pulse signal K1 from the pulse generator 22 is supplied as a switching control signal to an electronic switch (SW1) 24 which in turn, performs the switching operation between a density correction data memory 23 side and a calculation circuit 25 side in accordance with the data-switching pulse signal K1 outputted therefrom. The density correction data memory 23 and the calculation circuit 25 will be described hereinafter in detail. The data-switching pulse signal K1 is also supplied to a level counter 15 which acts as an up-and-down counter which performs the switching between the up-counting operation and the down-counting operation in accordance with the data-switching pulse signal K1. As will be described hereinafter, the level counter 15 is used as a down-counter on the above-mentioned first energization and used as an up-counter on the above-mentioned second energization. Because of the requirement that the completions of the first energizations for the respective heating elements R1 to Rn are coincident in timing with each other and the starts of the second energizations therefor are coincident in timing with each other, the level counter 15 whose output is supplied to a density data comparing circuit 14 (which will be described hereinafter) acts as a down-counter on the first energization, while acting as an up-counter on the second energization.

Here, the first energization means that pre-heating is effected by supplying currents to the respective heating elements R1 to Rn in accordance with density correction data in the density correction data memory 23 which corresponds to the variations of the resistances of the respective heating elements R1 to Rn, i.e., by supplying a current thereto in accordance with density data corrected in correspondance with each of the resistances thereof. On the other hand, the second energization means that printing is performed by supplying currents to the respective heating elements R1 to Rn in accordance with the image data which are outputted from the calculation circuit 25 and which are corrected in correspondance with the variations of the resistances of the respective heating elements R1 to Rn. The addresses 1, 2, . . . , n outputted from an address counter 11 (which will be described hereinafter) one-to-one corresponds to the respective heating elements R1 to Rn.

A description will be made hereinbelow in terms of the first energization, which is not a batch energization to the respective heating elements R1 to Rn but is a pre-heating energization performed in correspondance with the variations of the resistances of the respective heating elements R1 to Rn. That is, in a read-only memory (ROM) or others of the density correction data memory 23, there is in advance stored density correction data corresponding to the variations of the resistances of the respective heating elements R1 to Rn. For example, the density correction data are data for checking whether the resistance of each of the heating elements R1 to Rn is higher or lower than the average value of the resistances of the heating elements R1 to Rn so as to allow the heat values of the respective heating elements R1 to Rn to become constant, or data for making constant the heat values of the respective heating elements R1 to Rn on the basis of either the maximum value or minimum value of the resistances of the respective heating elements R1 to Rn.

The above-mentioned address counter 11 is responsive to a reference clock signal (for example, 3 MHz) supplied from an external circuit (not shown) through an input terminal 12 thereto, and further responsive to the start pulse signal J1 supplied thereto from the pulse generator 22 so as to output to the density correction data memory 23 the first address (the address for the first heating element R1) on the first energization. At this time, the electronic switch 24 (SW1) is operated in accordance with the data switching pulse signal K1 from the pulse generator 22 so as to be coupled to the density correction data memory 23 side. This arrangement acts as a switching means for performing the switching operation between the density correction data to be outputted from the density correction data memory 23 and the corrected image data to be outputted from the calculation circuit 25.

Furthermore, due to the data-switching pulse signal K1 from the pulse generator 22, the level counter 15 is set as the down counter, and due to the start pulse signal J1 therefrom, it is set to a value (signal) which is [m] above the maximum value of the density correction data stored in the density correction data memory 23. Here, the value [m] in the level counter 15 is a value below 6 bits [below 63], for instance.

The density correction data in the density correction data memory 23 which correspond to the first address in the first time (first cycle) on the first energization are supplied to the above-mentioned density data comparing circuit 14, which is also responsive to the value [m] of the level counter 14. In the density data comparing circuit 14, both the values are compared with each other. If the density correction data is greater than the value [m] in the level counter 15, the density data comparing circuit 14 outputs a control data [1] to a shift register 16. On the other hand, if the density correction data is equal to or smaller than the value [m], it outputs a control data [0] thereto. After the completion of the process at the first address at the first time of the first energization, the address counter 11 successively supplies to the data memory 10 the second to nth addresses (the addresses for the heating elements R2 to Rn). The data memory 10 successively supplies to the density data comparing circuit 14 the density correction data corresponding to each of the second to nth addresses. Here, at this time, the level counter 15 keeps the [m] state. With the above-described process being successively performed, the density data comparing circuit 14 supplies the control data [0] or [1] to the shift register 16, thereby terminating the process of a step 1 shown in FIG. 5.

On the other hand, the shift register 16 having n stages successively receives the control data [0] or [1] corresponding to the first to nth addresses in the first time on the first energization and supplies them to a latch circuit 17. This process is shown as a step 2 in FIG. 5. After completely counting the first to nth addresses in the first time on the first energization, the address counter 11 supplies a data transfer pulse L1 to the level counter 15 and further to the latch circuit 17. At the time of input of the data transfer pulse L1, the latch circuit 17 latches the control data [0] or [1] outputted from the shift register 16 and supplies them to ones of input terminals of gate circuits G1 to Gn, respectively. The other input terminals of the gate circuits G1 to Gn are coupled through a terminal 28 to a fixed voltage (VCC). Thereafter, the control data are led to the bases of transistors T1 to Tn, respectively, thereby performing the pre-heating of the respective heating elements R1 to Rn. These processes correspond to steps 3 and 4 in FIG. 5.

Figure 5:
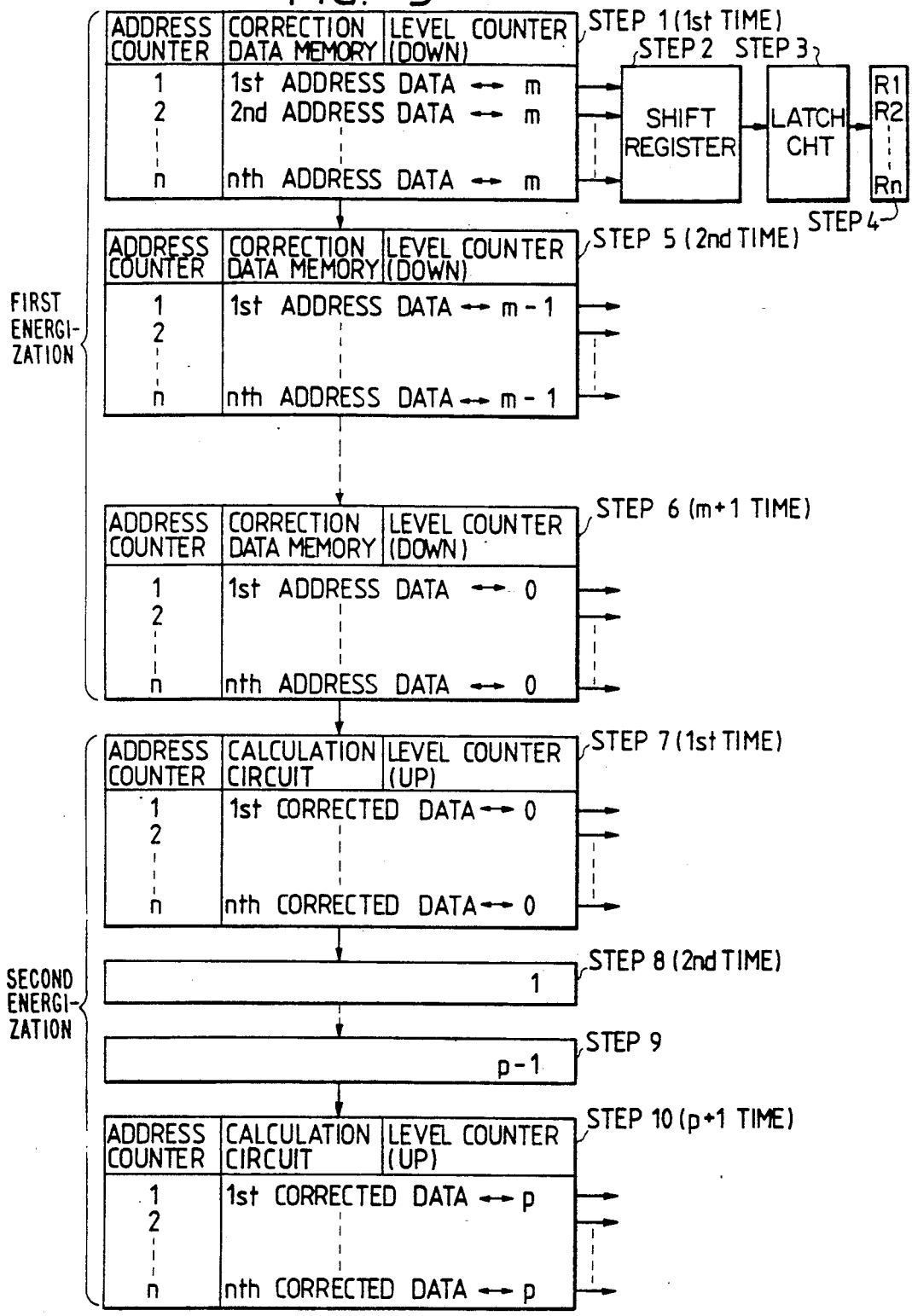
FIG. 5 is a flow chart showing the operation of the energization control system according to the first embodiment of this invention.

Furthermore, in response to the next data transfer pulse L1 from the address counter 11, the value of the level counter 15 is changed from [m] to [m−1], after which the process for the first to nth addresses in the second time on the first energization are executed, that is, a step 5 in FIG. 5 is executed. Thereafter, the operational flow successively advances up to a step 6 to successively perform the similar processes in response to the level counter 15 counting down up to [0].

A description will be made hereinbelow in terms of the second energization for supplying currents to the respective heating elements R1 to Rn for printing in response to the completion of the first energization for the pre-heating of the respective heating elements R1 to Rn. At this stage, as described above, the digitized image signal is stored in the data memory 10.

First, the address counter 11 supplies the first address (the address for the heating element R1) in the first time on the second energization to the data memeory 10 and further to the density correction data memory 23. As described above, the density correction data memory 23 stores the density correction data corresponding to the variations of the resistances of the respective heating elements R1 to Rn. The image signal corresponding to the first address in the first time on the second energization is led from the data memory 10 to the calculation circuit 25, and at the same time the density correction data corresponding thereto is led from the density correction data memory 23 to the same calculation circuit 25. The calculation circuit 25 processes the inputted image signal and density correction data so as to produce image data corrected in correspondance with the variations of the resistances of the respective heating elements R1 to Rn. Here, in cases where the input means is merely constructed so as to receive a digitized sequential image signal, it is possible to input to the calculation circuit 25 only an image signal synchronized with the address.

On the other hand, in response to the completion of the first energization, the level counter 15 is set to an up-counter in accordance with the start pulse J2 and the data-switching pulse K1. At this time, the level counter 15 is set to have a value [0]. Here, on the second energization, the maximum value of the corrected image data is below [p]. Thus, as shown in FIG. 5, the up-counter 15 has the value [p] as the maximum value, for example, a value below 8 bits (below 255). The electronic switch 24 is switched to the calculation circuit 25 side by means of the data-switching pulse K1.

The corrected image data in the calculation circuit 25 which correspond to the first address in the first time on the second energization are supplied to the density data comparing circuit 14, and the value of [0] in the level counter 15 is also supplied to the density data comparing circuit 14. The density data comparing circuit 14 compares the image data from the calculation circuit 25 with the value of [0] from the level counter 15. If the image data are greater than the value [0], the density data comparing circuit 14 supplies the control data [1] to the shift register 16. On the other hand, if equal to or smaller than the value [0], the density data comparing circuit 14 supplies the control data [0] thereto.

Thus, after the completion of the process for the first address in the first time on the second energization, the address counter 11 successively supplies the second to nth addresses (the addresses for the heating elements R2 to Rn) to the data memory 10 and further to the density correction data memory 23. In response to each input of the addresses, the data memory 10 supplies the corresponding image signal to the calculation circuit 25 and the density correction data memory 23 supplies the corresponding density correction data to the same calculation circuit 25, whereby the calculation circuit 25 produces the corrected image data which are in turn supplied to the density data comparing circuit 14. Meanwhile, the level counter 15 is kept to be [0]. The density data comparing circuit 14 supplies the control data [0] or [1] to the shift register 16. These processes correspond to a step 7 shown in FIG. 5.

Thereafter, as well as the first energization, the shift register 16 successively receives the n-bit control data respectively corresponding to the first to nth addresses in the first time on the second energization and supplies them to the latch circuit 17. After counting the first to nth addresses in the first time on the second energization, the address counter 11 supplies the data transfer pulse L1 to the level counter 11 and further to the latch circuit 17. At the time of the input of the data transfer pulse L1, the latch circuit 17 latches the control data [1] or [0] outputted from the shift register 16, and then outputs then to ones of the input terminals of the gate circuits G1 to Gn whereby the respective heating elements R1 to Rn are actuated for printing. Furthermore, in response to the input of the data transfer pulse L1, the level counter 15 is set from [0] to [1]. Thereafter, in FIG. 5, as well as the previous step 7, a step 8 is executed to perform the processes for the first to nth addresses in the second time on the second energization. The similar processes are repeatedly performed to complete the printing until the value of the level counter 15 is successively increased up to [p] (step 10 in FIG. 5).

Figure 6:
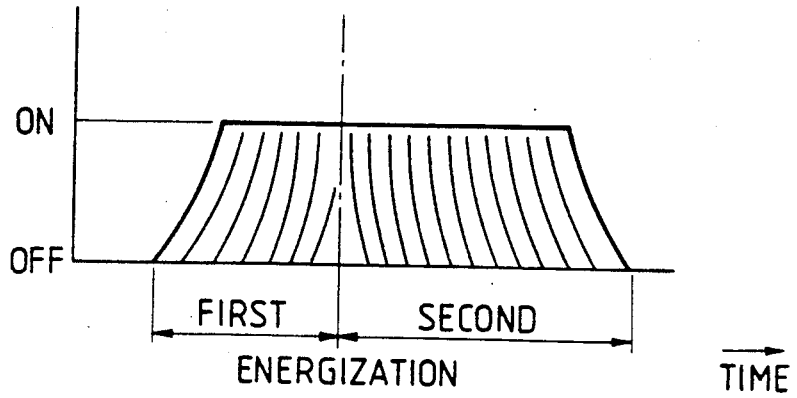
FIG. 6 is an illustration of the energization state of the first embodiment.

Here, the time required for the second energization for printing is longer than that of the first energization for pre-heating. This is because that as described above the maximum value of the level counter 15 on the second energization is greater than that of the level counter 15 on the first energization so as to finely supply the image data to the respective heating elements R1 to Rn to obtain a printed image with high quality. Thus, as illustrated in FIG. 6, the first and second energizations are performed for the time period of printing for one line. The one-line printing is repeatedly effected to thereby obtain a high-quality printed image.

Figure 8:
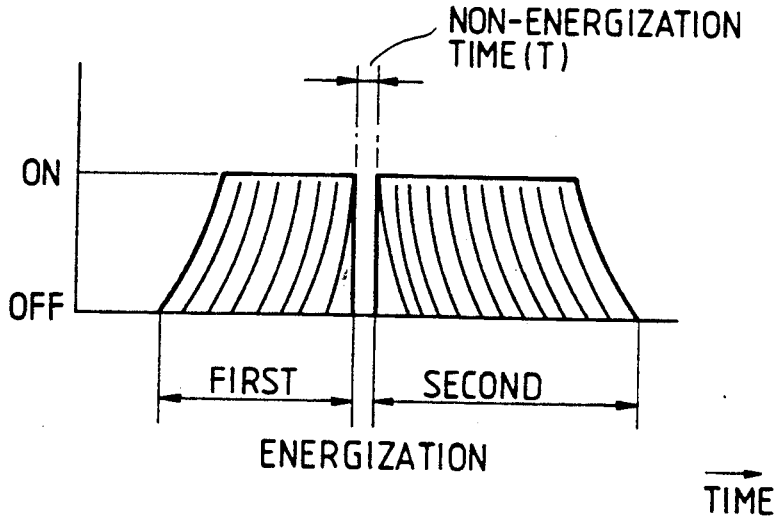
FIG. 8 is an illustration for describing the energization state of the second embodiment of this invention.
Figure 7:
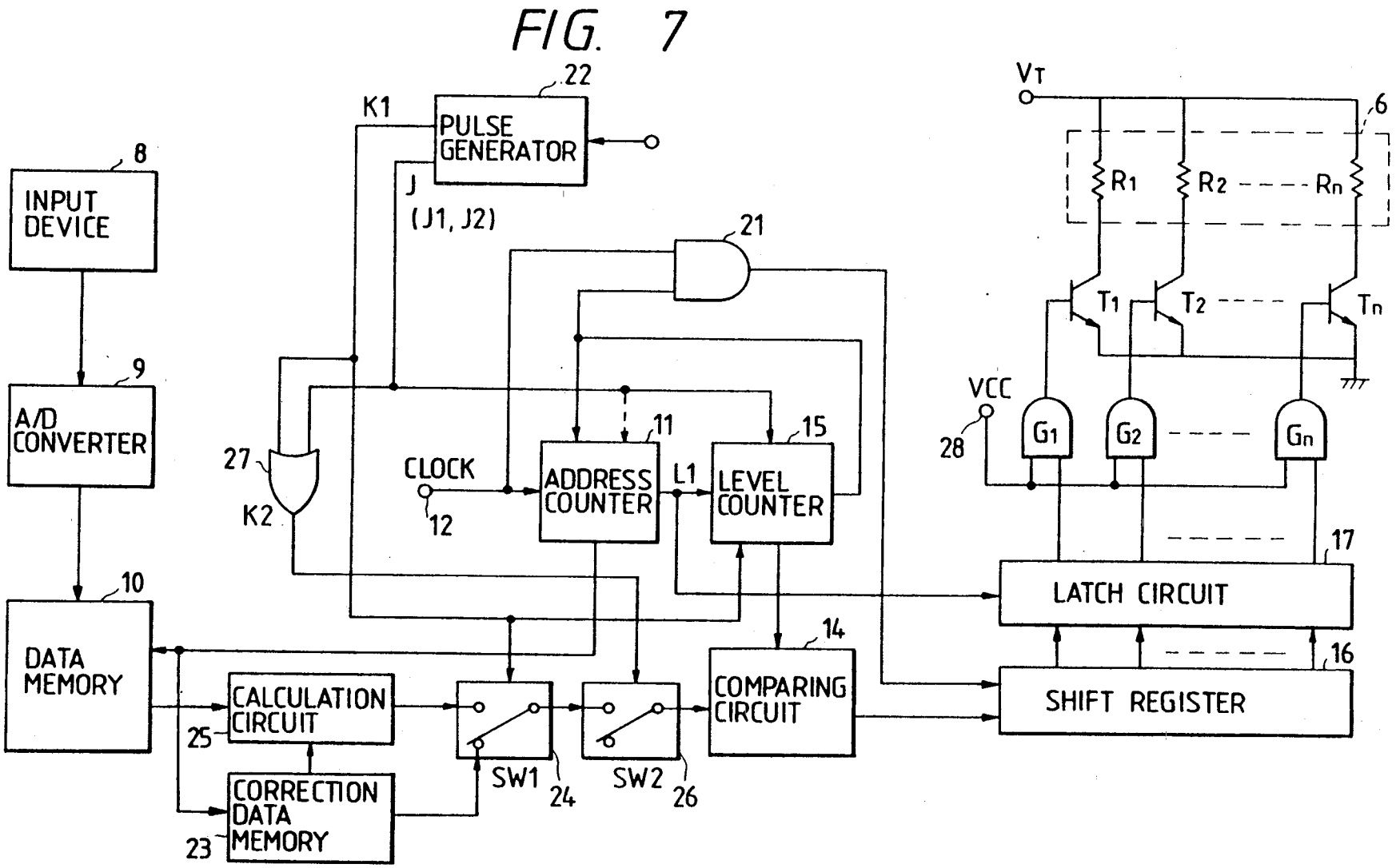
FIG. 7 is a block diagram showing an energization control system according to a second embodiment of this invention.

A second embodiment of this invention will be described hereinbelow with reference to FIGS. 7, 8 and 4. FIG. 7 is a block diagram showing an arrangement of an energization control system of the second embodiment where parts corresponding to those in FIG. 3 are marked with the same numerals and characters and the description thereof will be omitted for brevity. Although in the above-described first embodiment the switching operations to the density correction data memory 23 side on the first energization and the calculation circuit 25 side on the second energization are effected by means of the electronic switch 24 in accordance with the data switching pulse K1, in the second embodiment an electronic switch 26 (SW2) is also actuated and deactuated in accordance with a data switching pulse K2 as illustrated in FIG. 4. This data switching pulse K2 is produced by an OR gate 27 which is responsive to the data switching pulse K1 and the start pulses J1, J2. Here, it is appropriate that a terminal 28 coupled to ones of the input terminals of the gate circuits G1 to Gn is separated from the fixed voltage (VCC) and a strobing pulse signal corresponding to a data switching pulse signal K3 (see FIG. 4) produced by inverting the data switching pulse K2 is supplied to the terminal 28.

Thus, with this arrangement, the electronic switch 26 is coupled to the calculation circuit 25 side after being elapsed (delayed) by a time period corresponding to the width of the start pulse J2. As a result, as illustrated in FIG. 8, non-energized time period T is taken between the first and second energizations. This non-energized time period T allows recovery of the power source voltage, which is coupled to the line thermal head 6 and which can be dropped on the first energization. Accordingly, it is possible to reduce the size of the power source which drives the line thermal head 6, thereby reducing the cost of the thermal printer into which the energization control system of the second embodiment is incorporated.

Figure 9:
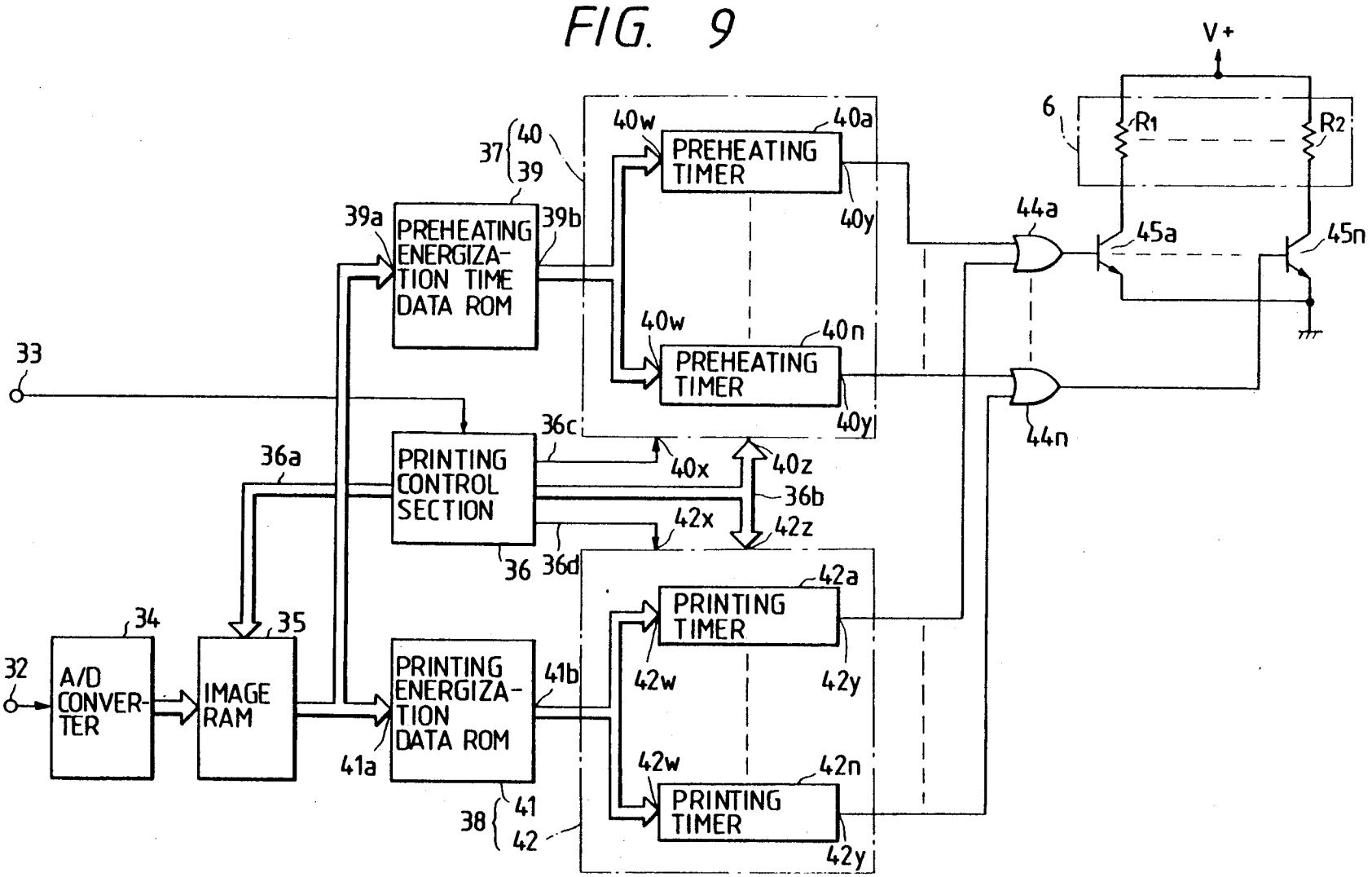
FIG. 9 is a block diagram showing an energization control system according to a third embodiment of this invention.

A third embodiment of this invention will be described hereinbelow with reference to FIGS. 9 and 10. FIG. 9 is a block diagram showing an arrangement of an energization control system according to the third embodiment which is incorporated into a thermal printer. In FIG. 9, illustrated at numeral 32 is an image signal input terminal for inputting an image signal corresponding to an image to be printed by this thermal printer, and illustrated at numeral 33 is a start-signal input terminal for inputting a start signal supplied from an external circuit, not shown. The image signal inputted to the input terminal 32 is supplied to an analog-to-digital (A/D) converter 34 which samples the inputted image signal at a period corresponding to the picture density so as to convert it into a digital signal with a bit length corresponding to the number of the gradational density levels in printing. The conversion output of the A/D converter is led to an image RAM (random access memory) 35 to be stored therein. A printing control section 36 is responsive to the start signal inputted through the input terminal 33 so as to successively reads out the density gradation data, stored in the image RAM 35, on the basis of the inputted start signal and supplies the read density gradation data to a preheating energization control section 37 and a printing energization control section 38. The printing control section 36 may be constructed as a microcomputer which is operable in accordance with a control program stored in a ROM (read-only memory), not shown. The preheating energization control section 37 is composed of a preheating energization time data ROM 39 and a timer section 40 including a plurality of preheating energization timer 40*a* to 40*n*. In the preheating energization time data ROM 39, there are stored concurrent-heating energization data corresponding to each of the density gradation data. The preheating energization time data are set so that the preheating energization time period becomes longer when the density level is higher and becomes shorter when the density level is lower. On the other hand, in response to application of the density gradation data (read out from the image RAM 35) to an input terminal 39*a*, the preheating energization ROM 9 outputs the corresponding preheating energization time data to an output terminal 39*b*. The output terminal 39 of the preheating energization time data ROM 39 is coupled to preset input terminals 40*w* of the preheating energization timers 40*a* to 40*n*. Each of the preheating energization timers 40*a* to 40*n* is equipped with a circuit for temporarily storing the data applied to the preset input terminal 40*w* and, in response to application of a preheating start signal 36*c* from the printing control section 36 to a timer start terminal 40*x*, supplies a high-level output to a timer output terminal 40*y* for a time period corresponding to the temporarily stored data. Here, the outputs of all the preheating energization timers 40*a* to 40*n* do not become the high-level in response to the application of the timer start signal but become high-level so that the timings of changes from the high-level to the low-level (stopping the timer output) are coincident with each other. That is, the timer in which the preheating energization time is set to be longer supplies the timer output earlier and the time in which the energization time is set to be shorter supplies the timer output later, whereby the preheating energization-completed timings are coincident with each other. Further, to an address designation terminal 40*z* of the energization timer section 40 is supplied a signal whereby one of the energization timers 40*a* to 40*n* where the output data from the energization time data ROM 39 are temporarily stored is selected.

The printing energization control section 38 is composed of a printing energization time data ROM 41 and a printing energization timer section 42 including a plurality of printing energization timers 42*a* to 42*n*. In the printing energization time data ROM 41, there are stored printing energization time data corresponding to each of the density gradation data. The printing energization time data are set such that the energization time period becomes longer as the gradational density level becomes higher. Here, the printing energization time period is not in direct proportion to the the density level but is set for each density level so that the printing density due to both the preheating energization and the printing energization takes a predetermined value. In response to application of the density gradation data (read out from the image RAM 35) to an input terminal 41*a*, the printing energization time data ROM 41 outputs the corresponding energization time data to its output terminal 41*b*. Each of the printing energization timers 42*a* to 42*n* is equipped with a circuit for temporarily storing the data inputted to each of input terminals 42*w* and, in response to input of the printing start signal from the printing control section 26 to a timer start terminal 42*x* of the printing energization timer section 42, supplies the high-level output to its timer output terminal 42*y* for a time period corresponding to the temporarily stored data. Here, an address designation terminal 42*z* of the printing energization timer section 42 is responsive to a signal from the printing control section 36 whereby one of the printing energization timers 42*a* to 42*n* where the data inputted from the printing energization time data ROM 11 are temporarily stored is determined.

Illustrated at numeral 6 is a thermal head provided with a plurality of heating elements R1 to Rn whose number is equal to the number of the preheating energization timers 40*a* to 40*n* and the number of the printing energization timers 42*a* to 42*n*. The outputs of the preheating and printing energization timers 40*a* to 40*n* and 42*a* to 42*n* are respectively supplied through OR gates 44*a* to 44*n* to NPN transistors 45*a* to 45*n*, thereby energizing the respective heating elements R1 to Rn.

A description will be made hereinbelow in terms of operation of this embodiment. In response to the start signal, the printing control section 36 outputs an address signal to an address bus 36*a* so as to derive the density gradation data from the image RAM 35. The derived density gradation data is converted into the preheating energization time data by means of the preheating energization time data ROM 39. The printing control section 36 generates a timer address signal 36*b* whereby the preheating energization time data is temporarily stored in the preheating energization timer 40*a*, for example. Similarly, the density gradation data derived from the image RAM 35 is converted into the printing energization time data by means of the printing energization time data ROM41 and then stored in the printing energization timer 42*a*, for example. After the density gradation data for the heating elements R1 to Rn are read out and the respective timers 40*a* to 40*n* and 42*a* to 42*n* are completely set on the basis of the stored data, the printing control section 36 outputs a preheating energization start signal 36*c* to therey start the respective preheating energization timers 40*a* to 40*n*, whereby the preheating powers corresponding to the printing densities are applied to the respective heating elements R1 to Rn. After the completion of the preheating, the printing control section 36 outputs a printing energization start signal 36*d* so as to start the respective printing energization timeres 42*a* to 42*n*, whereby the printing powers corresponding to the printing densities are applied to the respective heating elements R1 to Rn. With these operations, the printing for one line is completed after which the printing control section 36 performs the printing operation for the next line.

Figure 10:
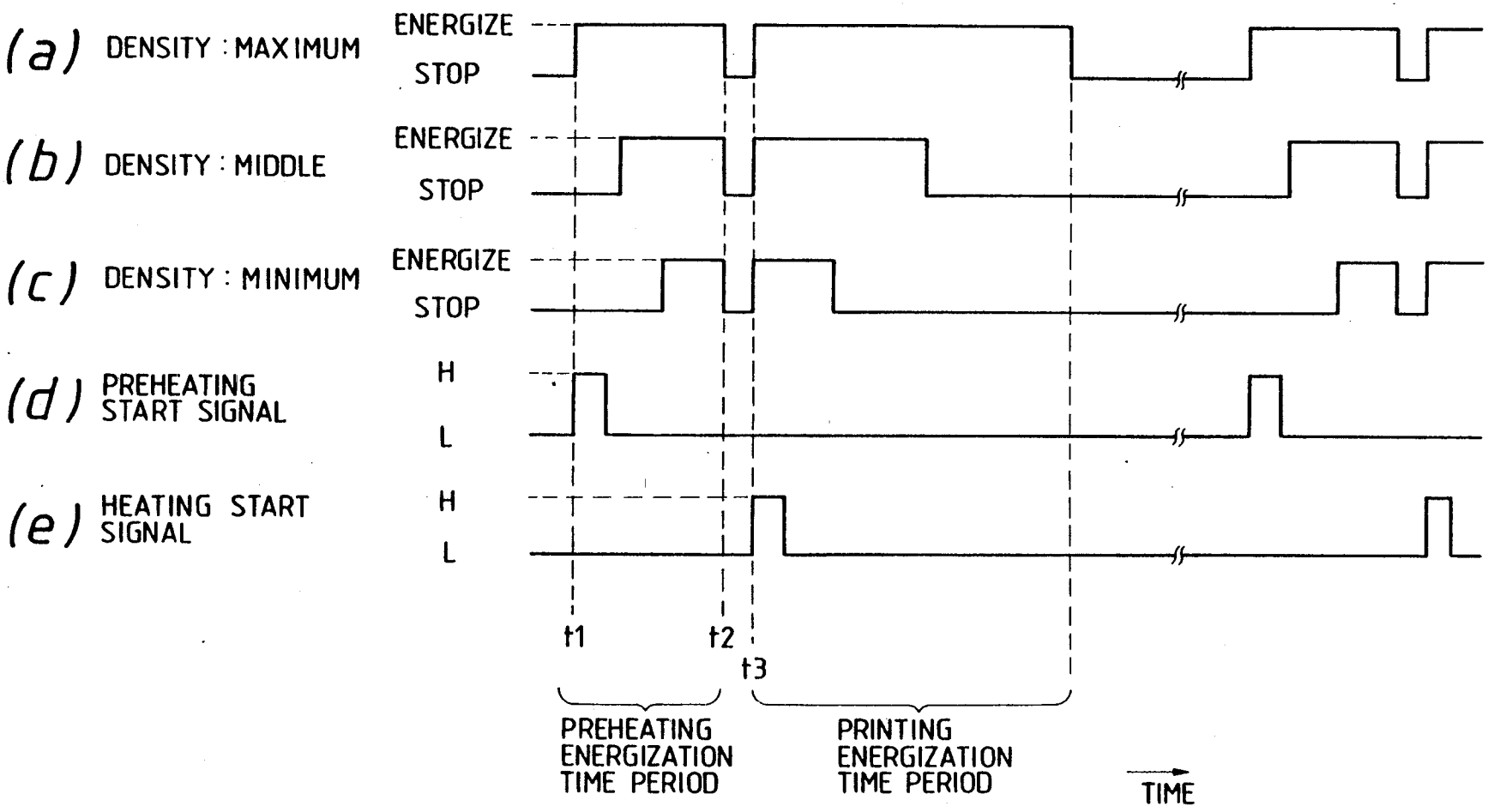
FIG. 10 is a timing chart for describing the operation of the third embodiment of this invention.

FIG. 10 is a time chart showing the relation between the printing density level and the energization time period. In FIG. 10, (a) indicates the case of the maximum density level, (b) illustrates the case of an intermediate density level, and (c) shows the case of the minimum density level. As illustrated in FIG. 10, in response to generation of the preheating energization start signal 36*c* at a time t1 (see (d) in FIG. 10), the preheating energization is started in the order of heightening the density and terminated at a time t2. Thereafter, the printing control section 36 generates the printing energization start signal 36*d* (see (e) in FIG. 10) whereby the printing energizations are respectively performed for time periods corresponding to the printing densities.

Although in this embodiment the preheating energization timers 40*a* to 40*n* and the printing energization timers 42*a* to 42*n* are arranged to be independent, it is appropriate that both the preheating energization and printing energization are effected by means of an integrally constructed timer means. Further, although in this embodiment the energization is continuously performed for a predetermined time period, it is also appropriate to perform pulses whose number corresponds to the printing density level. Still further, it is also possible to obtain the linearity of the printing density by adjusting the width of the energization pulse at every printing density level. Moreover, it is preferable that in multicolor printing the energization time period is determined at every color.

It should be understood that the foregoing relates to only preferred embodiments of the invention, and it is intended to cover all changes and modifications of the embodiments of the present invention herein used for the purposes of the disclosure, which do not constitute departures from the spirit and scope of the invention.

What is claimed is:

1. An energization control system for controlling energization of a thermal head of a thermal printer, said thermal head being equipped with a plurality of heating elements successively arranged in line, said elements being energized to generate heat in response to sufficient currents being supplied thereto so as to thermally and gradationally print an image on a recording sheet with printing densities corresponding to the supplied currents, said energization control system comprising:

inputting means for inputting an image signal whereby said thermal printer prints said image on said recording sheet through said thermal head;

density correction data memory means for storing density correction data corresponding to variations of resistances of said heating elements;

calculation circuit means coupled to said inputting means and said density correction data memory means for correcting the inputted image signal on the basis of said density correction data so as to produce image data;

level counter means arranged to act as an up-counter and a down-counter for generating first and second comparison signals; and data comparison means coupled to said level counter means and further selectively coupled through switching means to said density correction data memory means and the calculation circuit means for comparing said first and second comparison signals with said density correction data from said density correction data memory means and said image data from said calculation circuit means, said data comparison means performing first energization so as to energize said heating elements of said thermal head in accordance with a comparison result between said first comparison signal and said density correction data and, after completion of said first energization, performing second energization so as to energize said heating elements thereof in accordance with a comparison result between said second comparison signal and said image data.

2. An energization control system as claimed in claim 1, wherein said level counter means acts as the down-counter during said first energization and acts as the up-counter during said second energization.

3. An energization control system as claimed in claim 1, wherein said switching means is arranged so as to effect a switching operation so that said data comparison means is coupled to said calculation means for performing said second energization after elapse of a predetermined time period from the completion of said first energization.

* * * * *